US011404204B2

(12) United States Patent
Kondo et al.

(10) Patent No.: US 11,404,204 B2
(45) Date of Patent: Aug. 2, 2022

(54) IGNITION COIL FOR INTERNAL COMBUSTION ENGINE

(71) Applicant: DENSO CORPORATION, Kariya (JP)

(72) Inventors: Yuki Kondo, Kariya (JP); Takehiro Torii, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/241,403

(22) Filed: Apr. 27, 2021

(65) Prior Publication Data

US 2021/0335537 A1 Oct. 28, 2021

(30) Foreign Application Priority Data

Apr. 28, 2020 (JP) ..... JP2020-079702
Nov. 5, 2020 (JP) ..... JP2020-185270

(51) Int. Cl.
*H01F 38/12* (2006.01)
*F02P 3/02* (2006.01)

(52) U.S. Cl.
CPC ..... *H01F 38/12* (2013.01); *F02P 3/02* (2013.01)

(58) Field of Classification Search
CPC ..... H01F 38/12; H01F 2038/122; F02P 3/02
See application file for complete search history.

(56) References Cited

U.S. PATENT DOCUMENTS

2018/0108473 A1* 4/2018 Akimoto ..... F02P 3/02
2018/0309268 A1 10/2018 Idogawa

* cited by examiner

*Primary Examiner* — Jacob M Amick
(74) *Attorney, Agent, or Firm* — Nixon & Vanderhye P.C.

(57) ABSTRACT

An ignition coil for an internal combustion engine includes a plug boot with a hole having a length extending in an axial direction of the ignition coil. The length of the hole has a portion which includes a plurality of small distance-to-center sections and a plurality of large distance-to-center sections which are arranged alternately in a circumferential direction of the hole. Each of the small distance-to-center sections is located at a first distance away from the center of the hole, while each of the large distance-to-center sections is located at a second distance away from the center of the hole. The second distance is larger than the first distance. The small distance-to-center sections are placed to be contactable with an outer periphery of the coil spring. This structure of the ignition coil has enhanced resistance to mechanical vibration of the coil spring and also has enhanced withstand voltage.

9 Claims, 16 Drawing Sheets

IGNITION COIL FOR INTERNAL COMBUSTION ENGINE

CROSS REFERENCE TO RELATED DOCUMENT

The present application claims the benefit of priority of Japanese Patent Application No. 2020-079702 filed on Apr. 28, 2020 and Japanese Patent Application No. 2020-185270 filed on Nov. 5, 2020, disclosures of which are incorporated herein by reference.

BACKGROUND

1 Technical Field

This disclosure relates generally to an ignition coil for internal combustion engines.

2 Background Art

Ignition coils for internal combustion engines are used in igniting an air-fuel mixture in a combustion chamber of the internal combustion engine. The ignition coil usually includes a coil body and a joint. The coil body has a primary winding and a secondary winding which are disposed in a case. The joint is equipped with a coil spring and a plug boot. The coil spring is electrically connected to a high-voltage side of the secondary winding. The plug boot has the coil spring disposed therein.

For instance, International publication No. WO2017/081788 teaches an ignition coil for internal combustion engines which is designed to has an improved structure of a plug boot in order to avoid lateral oscillation of a coil spring and improve the degree of freedom of design of the coil spring. Specifically, the ignition coil has two reduced clearances between the coil spring and an inner wall of the plug boot. The reduced clearances are arranged away from each other in an axial direction of the coil spring and the plug boot and created by a small-diameter portion of the plug boot and a large-diameter portion of the coil spring, respectively.

The small-diameter portion of the plug boot is defined by a plurality of ribs which protrude inwardly from the inner wall of the plug boot and arranged away from each other in a circumferential direction of the plug boot. Each of the ribs is formed by a sharp convex portion of the inner wall of the plug boot.

In the above structure, when an electrical spark is produced in a spark plug attached to an ignition device, it results in concentration of electric field between the coil spring and each of the ribs, which leads to a risk that electric current may leak to an outer periphery of the plug boot. The concentration of electric field has been found to arise from a point contact of a head of each of the ribs with the coil spring and a sharp change in shape of the inner wall of the plug boot which is brought by each of the ribs. There is also a concern that the coil spring might be caught between the adjacent ribs, thereby resulting in rapid leakage of electric current from the coil spring.

It is, therefore, necessary to further improve the structure of the plug boot in order both to improve the resistance of the coil spring to lateral vibration and to enhance electric strength or voltage endurance thereof to minimize the leakage of electric current from the coil spring.

SUMMARY

It is, thus, an object of this disclosure to provide an ignition coil for internal combustion engines which is designed to have enhanced vibration and electrical resistances of the coil spring.

According to one aspect of this disclosure, there is provided an ignition coil for an internal combustion engine which comprises: (a) a coil body which includes a primary winding, a secondary winding magnetically coupled with the primary winding, and a case in which the primary winding and the secondary winding are disposed, the coil body being configured to be arranged outside a plug hole of an internal combustion engine; and (b) a joint which includes a coil spring and a plug boot and is configured to be arranged inside the plug hole, the coil spring electrically connecting between a high-voltage end of the secondary winding with a spark plug. The plug boot connects with the case and has a hole in which the coil spring is disposed. The hole has a length extending in an axial direction of the plug boot. The length of the hole has at least a portion which includes a plurality of small distance-to-center sections and a plurality of large distance-to-center sections which are arranged alternately in a circumferential direction of the hole. Each of the small distance-to-center sections is located at a first distance (r1) away from a center of the hole. Each of the large distance-to-center sections is located at a second distance (r2) away from the center of the hole. The second distance is larger than the first distance. The small distance-to-center sections are configured to be line-contactable with an outer periphery of the coil spring.

The above ignition coil has a unique shape of the plug boot which is designed to enhance vibration and voltage resistance of the coil spring. Specifically, the plug boot has the hole in which the coil spring is disposed. The length of the hole has at least a portion which includes the plurality of small distance-to-center sections and the plurality of large distance-to-center sections which are arranged alternately in a circumferential direction of the hole. The small distance-to-center sections are geometrically configured to be line-contactable with an outer periphery of the coil spring. For instance, at least one of the small distance-to-center sections may be placed in line contact with the outer periphery of the coil spring.

Specifically, the small distance-to-center sections are each designed in the shape of a straight line or a gentle curve in a transverse cross section of the hole extending perpendicular to the axial direction. This enables the outer periphery of the coil spring to be line-contactable with the small distance-to-center sections in the circumferential direction. The small distance-to-center sections are designed not to create a sharp change in shape of the hole.

The plurality of straight line segments serve to minimize mechanical vibrations of the coil spring in a direction perpendicular to the axial direction within the hole of the plug boot, minimize occurrence of concentration of electric field between the coil spring and the cylindrical joint when the ignition coil is being activated, and eliminate a probability that a portion(s) of the coil spring from may be caught undesirably in an recess inside the hole to avoid occurrence of leakage of electric current from the coil spring.

As apparent from the above discussion, the structure of the ignition coil has enhanced resistance to mechanical vibration of the coil spring and also has enhanced ability to withstand voltage.

The coil spring is made of wire whose transverse cross section is circular. The wire is wound in a spiral form. The line contacts of the outer periphery of the coil spring and the small distance-to-center sections are, therefore, oriented obliquely to the axial direction and arranged adjacent each other in the circumferential direction.

The small distance-to-center sections are sections of the outer shape of the hole which are located at a small distance from the center of the hole. The large distance-to-center sections are sections of the outer shape of the hole which are located at a large distance from the center of the hole.

Symbols in brackets attached to component parts, as discussed below, are used only to indicate exemplified correspondences between the symbols and the component parts.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

First Embodiment

The ignition coil 1 for use in an internal combustion engine according to the first embodiment will be described below with reference to the drawings.

Figure 1:
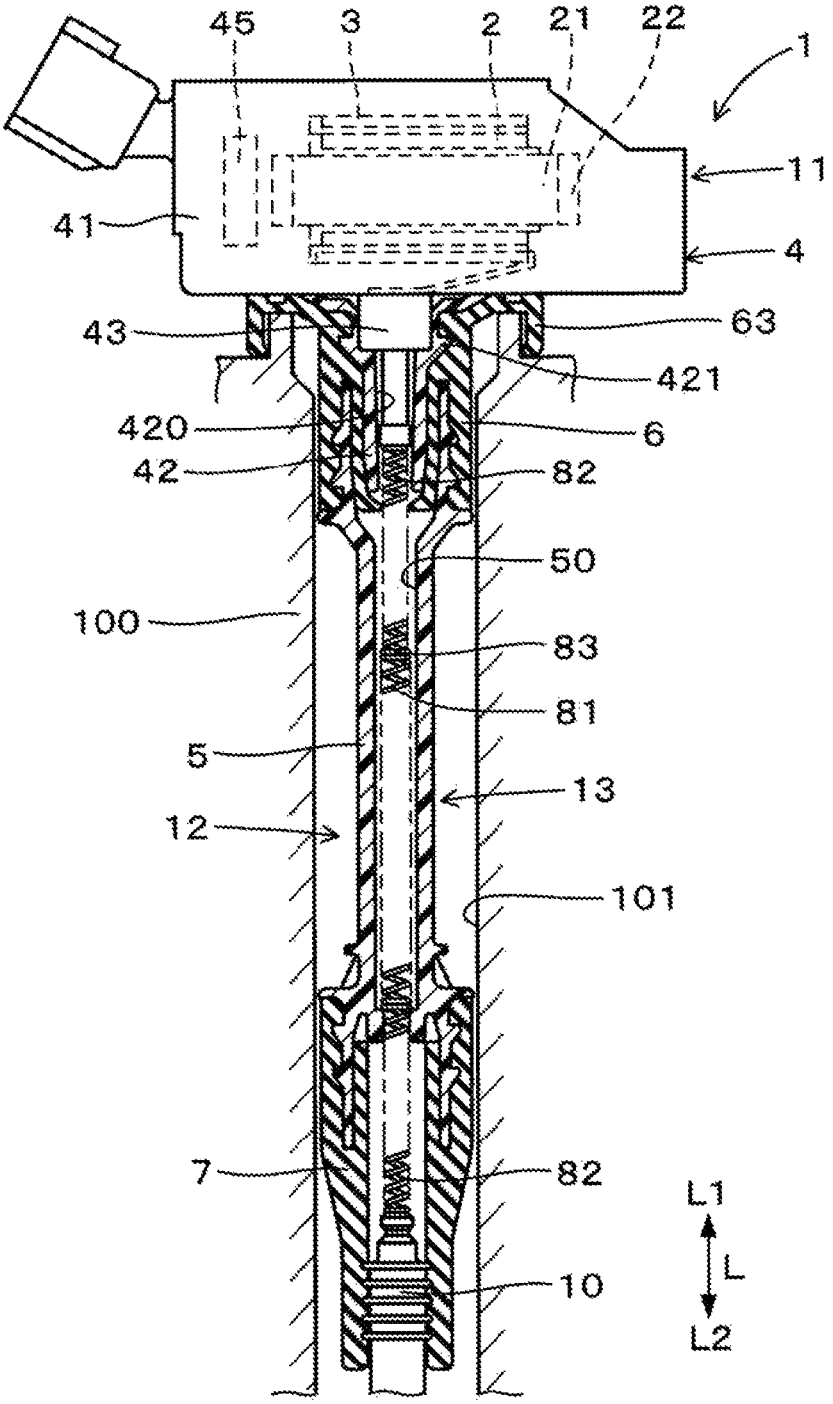
FIG. 1 is a longitudinal sectional view which illustrates an ignition coil with a plug boot according to the first embodiment.
Figure 2:
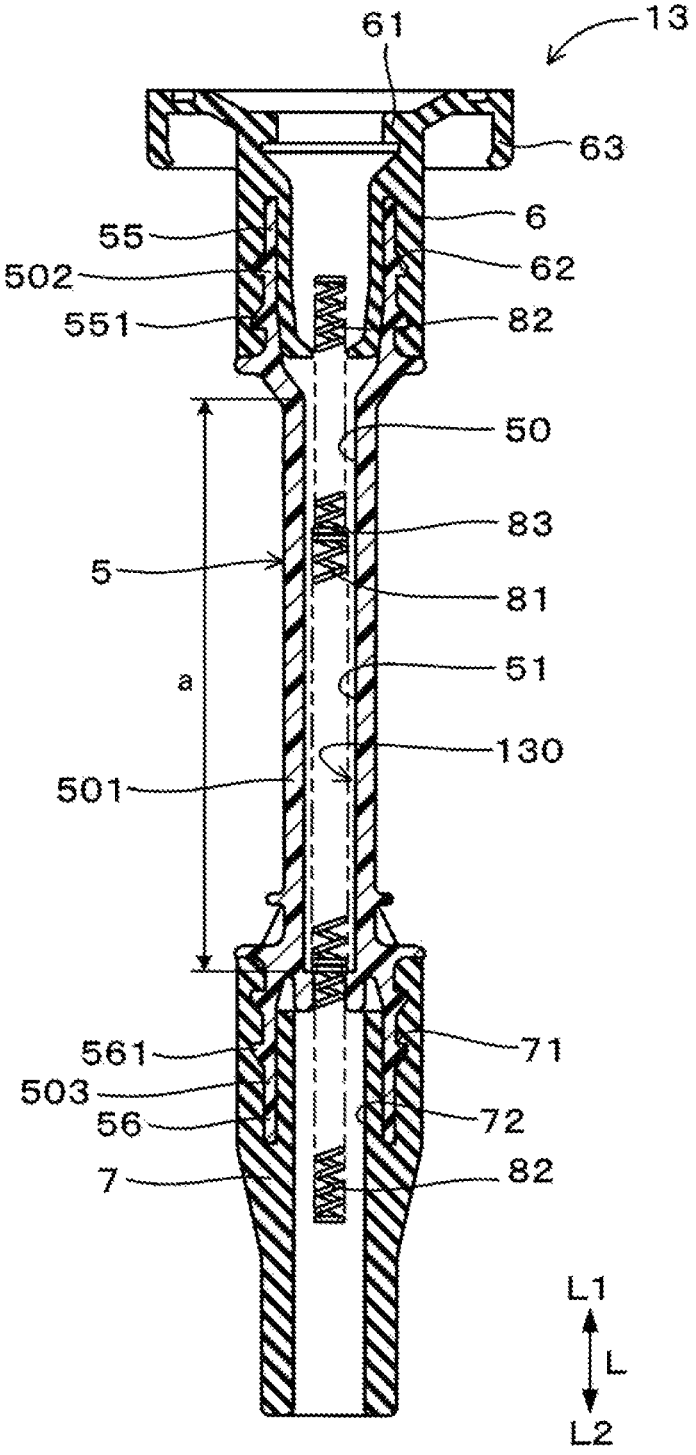
FIG. 2 is a longitudinal sectional view which illustrates a plug boot according to the first embodiment.

The ignition coil 1, as illustrated in FIGS. 1 and 2, includes the coil body 11 and the joint 12. The coil body 11 is equipped with the primary winding 2, the secondary winding 3 magnetically coupled with the primary winding 2, and the case 4 with which the primary winding 2 and the secondary winding 3 are covered. In use, the coil body 11 is arranged outside the plug hole 101 of the internal combustion engine. The joint 12 is equipped with the coil spring 8 and the plug boot 13. The coil spring 8 electrically connects a high-voltage end of the secondary winding 3 with the spark plug 10. The plug boot 13 is connected to the case 4 and has the hollow hole 130 in which the coil spring 8 is disposed. In use, the joint 12 is disposed inside the plug hole 101.

Figure 3:
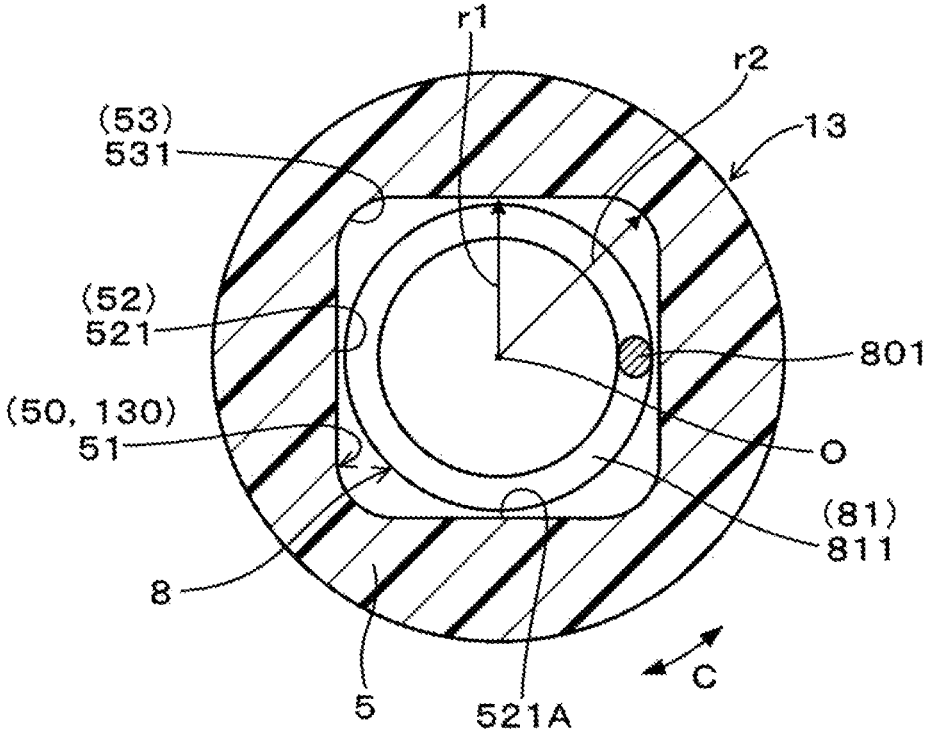
FIG. 3 is a transverse sectional view which illustrates a plug boot according to the first embodiment.

The plug boot 13 has a given length extending in an axial direction L of the hole 130. The length of the plug boot 13 has a portion, as illustrated in FIG. 3, equipped with a plurality of small distance-to-center sections 52 and a plurality of large distance-to-center sections 53 which are arranged alternately in a circumferential direction C of the hole 130. In other words, each of the small distance-to-center sections 52 is located between a respective adjacent two of the large distance-to-center sections 53. The small distance-to-center sections 52 are physically line-contactable with an outer periphery of the coil spring 8. In this embodiment, all the small distance-to-center sections 52 are arranged away from the outer periphery of the coil spring 8 through a gap, but however, brought into line-contact with the outer periphery of the coil spring 8 when mechanical vibration acts on the coil spring 8 in a radial direction of the ignition coil 1. At least one of the small distance-to-center sections 52 may alternatively be disposed in direct line contact with the outer periphery of the coil spring 8. Each of the large distance-to-center sections 53 is located at a distance r2 away from the center O of the hole 130. Each of the small distance-to-center sections 52 is located at a distance r1 away from the center O of the hole 130. The distance r2 is larger than the distance r1.

The structure of the ignition coil 1 will be described below in detail.

Ignition Coil 1

The ignition coil 1 is, as can be seen in FIG. 1, installed in the cylinder head cover 100 of the internal combustion engine mounted in the vehicle to create a sequence of electric sparks in a combustion chamber of a cylinder head of the engine using the spark plug 10 mounted in the cylinder head. The ignition coil 1 in this embodiment is designed for use in the vehicle. The ignition coil 1 includes the coil body 11 made up of the primary winding 2, the secondary winding 3, and the case 4 and the joint 12 which protrudes from the coil body 11 and in which the spark plug 10 is fit. The coil body 11 is disposed on the cylinder head cover 100. The joint 12 is arranged inside the plug hole 101 of the cylinder head cover 100.

Axial Direction L

The axial direction L, as referred to herein, is a direction in which a longitudinal center line (i.e., an axis) of the plug boot 13 extends, in other words, the length of the plug boot 13 extends. A region of the ignition coil 1 where the coil body 11 lies or an end of the ignition coil 1 which has the coil body 11 will also be referred to as a base end side or simply a base end L1 of the length of the ignition coil 1 extending in the axial direction L. A region of the ignition coil 1 where the joint 12 lies or an end of the ignition coil 1 which faces away from the coil body 11 will also be referred to as a front end side or simply a front end L2 of the length of the ignition coil 1.

Primary Winding 2

The primary winding 2 is made of a winding of magnet wire and arranged on a primary spool. The primary winding 2 is deexcited by a switching device of the igniter 45. In other words, the primary winding 2 is repeatedly excited and then deexcited. The primary winding 2 has the center core 21 disposed inside an inner periphery thereof. The primary winding 2 also has the outer core 22 disposed outside an outer periphery thereof.

Secondary Winding 3

The secondary winding 3 is arranged outside the outer periphery of the primary winding 2 to be coaxial with the primary winding 2. The secondary winding 3 is made of a winding of magnetic wire which is thinner than that of the primary winding 2, but is larger in number of turns than that of the primary winding 2. The secondary winding 2 is disposed on an outer periphery of a secondary spool. When the primary winding 2 is deexcited, it will cause the secondary winding 3 to create induced electromotive force by means of mutual induction with the primary winding 2.

Case 4

The case 4 is, as illustrated in FIG. 1, made of thermoplastic resin and has a recess or chamber in which the primary winding 2 and the secondary winding 3 are disposed. When the primary winding 2, the secondary winding 3, and the igniter 45 are arranged in the chamber of the case 4, the case 4 is filled with thermosetting resin without any clearances. The igniter 45 is equipped with a switch which is responsive to a control signal outputted from an engine controller disposed outside the ignition coil 1 to excite or deexcite the primary winding 2.

The case 4 includes the case body 41 and the tower 41 which protrudes from the case body 41 and to which the plug boot 13 of the joint 12 is attached. The tower 42 is of a hollow cylindrical shape and has formed on an outer periphery thereof the fastening protrusion 421 on which the rubber seal 6 of the plug boot 13, which will be described later in detail, is fit. The tower 42 has the hollow tower hole 420 formed in a central portion thereof. The tower hole 420 has the connecting member 43 and a portion of the coil spring 8 disposed therein. The connecting member 43 is electrically connected to the high-voltage end of the secondary winding 3. The portion of the coil spring 8 is placed in contact with the connecting member 43.

Plug Boot 13

The plug boot 13, as illustrated in FIGS. 1 and 2, includes the hollow cylindrical joint 5, the rubber seal 6, and the rubber-made plug cap 7. The cylindrical joint 5 is made of resin and has the hollow cylindrical hole 50 formed therein. The rubber seal 6 is made of rubber and connect with the base end 502 of a length of the cylindrical joint 5 extending in the axial direction L and the tower 42 of the case 4. The plug cap 7 is made of rubber, connects with the front end 503 of the length of the cylindrical joint 5, and is fit on the spark plug 10. The plug boot 13 forms the joint 12 excluding the coil spring 8.

Cylindrical Joint 5

The cylindrical joint 5, as illustrated in FIG. 2, has the base end 502 facing away from the front end 503 in the axial direction L. The base end 502 has formed thereon the base-end fastening portion 55 to which the rubber seal 6 is joined. The base-end fastening portion 55 has formed on the outer periphery thereof the annular barbed base-end joining portions 551 which achieve a firm mechanical joint with the rubber seal 6. The front end 503 of the cylindrical joint 5 has the front-end fastening portion 56 on which the plug cap 7 is fit. The front-end fastening portion 56 has formed on an outer periphery thereof the front-end joining portions 561 which achieve a firm mechanical joint with the plug cap 7. The cylindrical joint 5 has formed in a central portion thereof the hollow cylindrical hole 50 through which the coil spring 8 passes.

The hole 50 of the cylindrical joint 5 is formed in the central portion 501 of the length of the cylindrical joint 5 extending in the axial direction L. The hole 50 is shaped to have a constant diameter. The base end 502 of the cylindrical joint 5 has an inner slant wall which is inclined to have an inner diameter increasing toward the base end L1 of the ignition coil 1. The inner diameter of the hole 50 in the base end 502 is larger than that in the central portion 501. The small distance-to-center sections 52 and the large distance-to-center sections 53 in this embodiment define the contact hole 51 in a central portion of the length of the hole 50 extending in the axial direction L. In other words, the contact hole 51 is formed by a portion of the length of the hole 50 and defined by the small distance-to-center sections 52 and the large distance-to-center sections 53 of the inner wall of the plug boot 13. The contact hole 51 is shaped to have a cross section which is kept constant in the center portion 501 of the hole 50 in the axial direction L.

Figure 4:
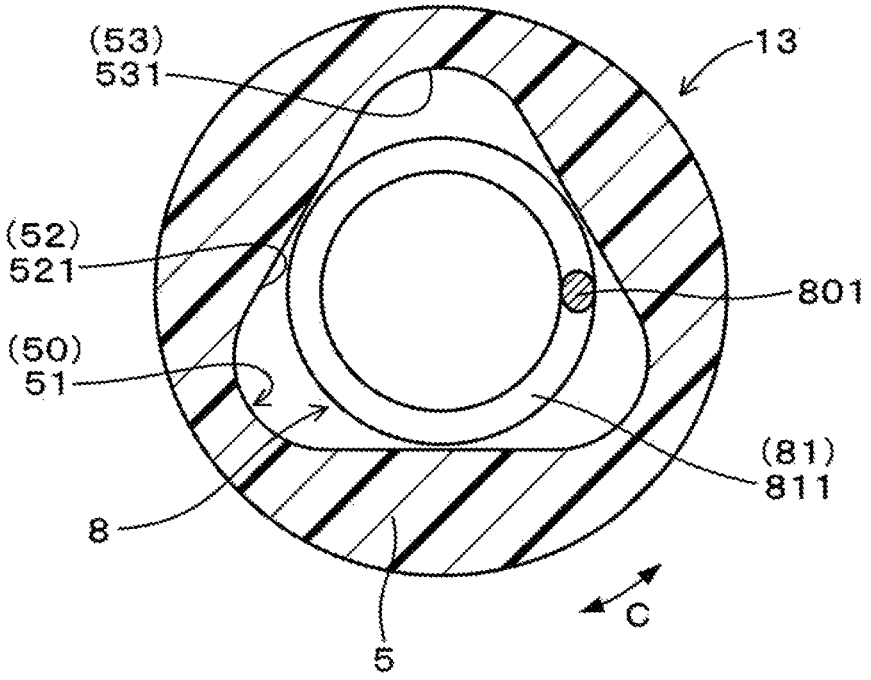
FIG. 4 is a transverse sectional view which illustrates a modification of a plug boot according to the first embodiment.
Figure 5:
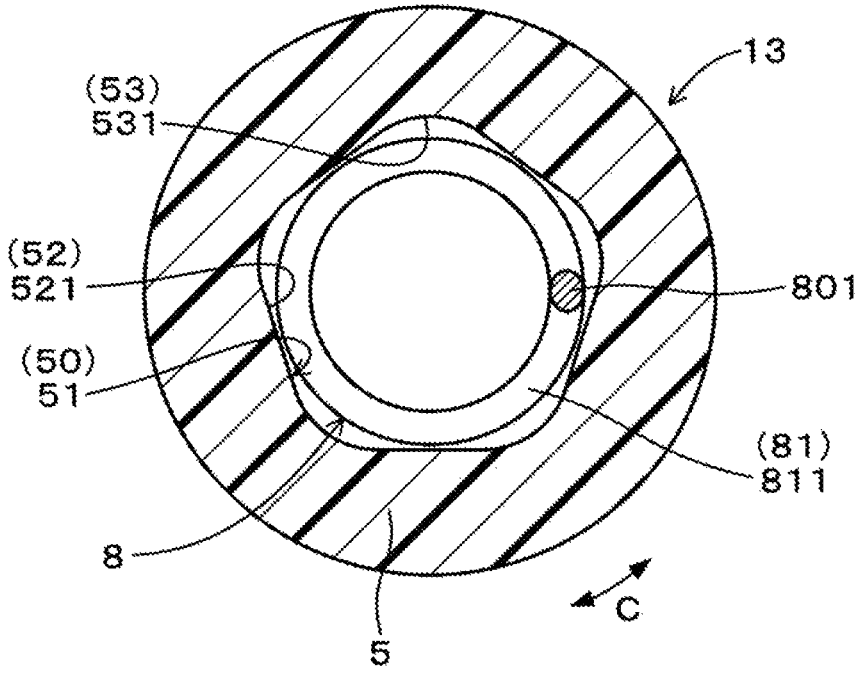
FIG. 5 is a transverse sectional view which illustrates a second modification of a plug boot according to the first embodiment.

The contact hole 51 of the hole 50, as can be seen in FIG. 3, has a cross section which extends perpendicular to the axial direction L and has a polygonal shape kept constant in the axial direction L. The cross section of the contact hole 51 extending perpendicular to the axial direction L in this embodiment is described by a plurality of straight line segments 521 and a plurality of corners 531. The straight line segments 521 correspond to sides of a polygon. Each of the corners 531 connects the two adjacent straight line segments 521 and corresponds to a vertex of the polygon. The cross section of the contact hole 51 is, as illustrated in FIG. 3, square in shape with the four straight line segments 521, but may alternatively be, as illustrated in FIG. 4, triangular in shape with the three straight line segments 521, as illustrated in FIG. 5, pentagonal in shape with the five straight line segments 521, or hexagonal in shape with the six straight line segments 521. Each of the corners 531 is shaped as a curve bulging outward of the plug boot 13. Each of FIGS. 3 to 5 illustrates a cross section of the cylindrical joint 5 of the plug boot 13 in which the contact hole 51 is formed.

Each of the small distance-to-center sections 52 is defined by one of the straight line segments 521. Similarly, each of the large distance-to-center sections 53 is defined by the corners 531. The shaping of the small distance-to-center sections 52 by the straight line segments 521 facilitates machining of the small distance-to-center sections 52. The distance between the center O of the contact hole 51 of the cylindrical joint 5 and each of the straight line segments 521 is minimized at the center of the length of the straight line segment 521. The length of each of the straight line segments 521 which substantially extends in the circumferential direction C, therefore, has the central portion 521A placed to be contactable with the outer periphery of the coil spring 8.

Each of the straight line segments 521 of the contact hole 51 is contactable with the outer periphery of the coil spring 8 at a plurality of locations which are away from each other in the axial direction L, as viewed on a cross section of the central portion 521A defined to extend in the axial direction L. In other words, the wire 801 of the coil spring 8 is configured to be line-contactable with the central portion 521A of each of the straight line segments 521 at a plurality of locations away from each other in the axial direction L in the contact hole 51. Specifically, the line contacts of the wire 801 with each of the central portions 521A are oriented obliquely to the axial direction L because the wire 801 is wound in a spiral form to make the coil spring 8.

The contact hole 51, as illustrated in FIG. 2, has a length a occupying more than or equal to one-half of an entire length of the coil spring 8 in the axial direction L. In other words, the contact hole 51 occupies a length of the hole 50 which is identical with the length a in the axial direction L. This enables each of the small distance-to-center sections 52 of the contact hole 51 to contact the outer periphery of the coil spring 8 in an increased range of the hole 50 in the axial direction L.

Rubber Seal 6

The rubber seal 6 is, as clearly illustrated in FIGS. 1 and 2, is fit both on the tower 42 of the case 4 and on the base end 502 of the cylindrical joint 5. Specifically, the rubber seal 6 is firmly attached to the outer periphery of the tower 42 and the outer surface of the case 4. The rubber seal 6 includes the annular rubber fastening portion 61 which is firmly fit on the fastening protrusion 421 of the tower 42 of the case 4, the rubber fastening portions (i.e., annular grooves) 62 which are firmly fit on the base-end joining portions 551 of the cylindrical joint 5, and the sealing portion 63 which hermetically closes the plug hole 101.

Plug Cap 7

The plug cap 7 is fit on the front end 503 of the cylindrical joint 5 and equipped with the cup fastening portions (i.e., annular grooves) 71 firmly fit on the front-end joining portions 561 of the cylindrical joint 5. The plug cap 7 has formed in a central portion thereof the mount hole 72 in which a center electrode of the spark plug 10 is disposed.

Coil Spring 8

Figure 6:
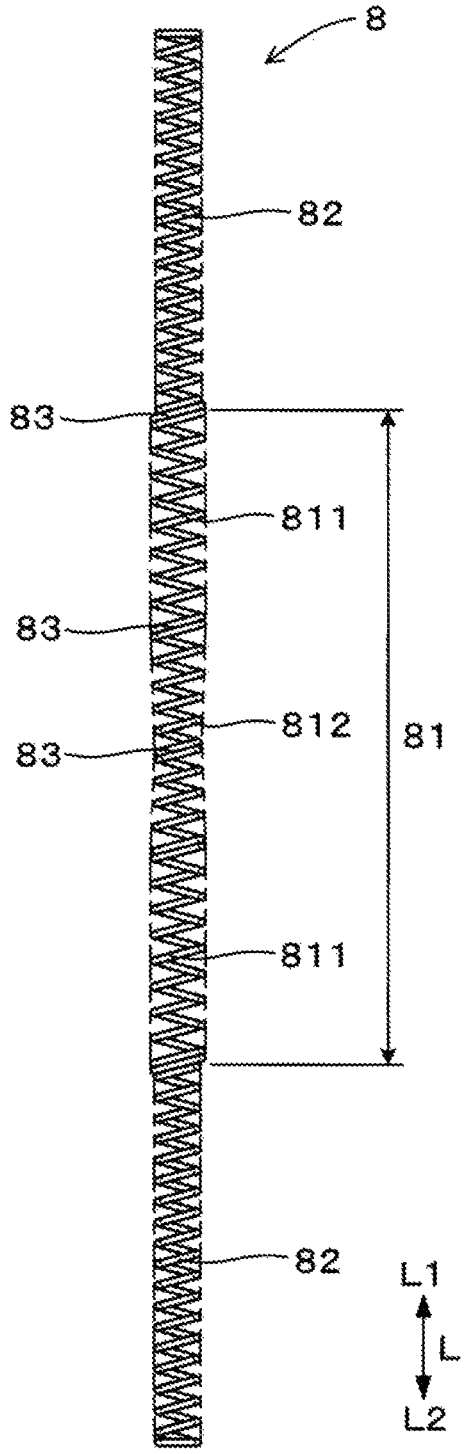
FIG. 6 is a longitudinal view which illustrates a coil spring installed in the ignition coil shown in FIG. 1 in the first embodiment.

The coil spring 8 is, as can be seen in FIG. 6, implemented by a torsion coil spring and generate an elastic repulsive force when compressed in the axial direction L. The coil spring 8 is made of a spiral winding of the wire (e.g., copper wire) 801 which is circular in cross section. The coil spring 8 has a length which extends in the axial direction L and includes the large-diameter portion 81 and two small-diameter portions 82. The large-diameter portion 81 is the largest in diameter of the length of the coil spring 8 and interposed between the small-diameter portions 82 in the axial direction L. The small-diameter portions 82 are smaller in diameter than the large-diameter portion 81. The small-diameter portions 82 are symmetrical in shape thereof with respect to the center of the length of the coil spring 8. In other words, the coil spring 8 is symmetrical in shape with respect to the center of the length thereof extending in the axial direction L.

The large-diameter portion 81 occupies, in other words, is located in a central portion of the length of the coil spring 8, thereby facilitating or ensuring the stability in making physical contact of the large-diameter portion 81 with the inner wall of the contact hole 51 of the cylindrical joint 5. The coil spring 8, in other words, the small-diameter portions 82 are symmetrical with respect to the center of the length of the coil spring 8, thereby eliminating the need for paying attention to orientation of the coil spring 8 when inserted into the plug boot 13. This facilitates assembly of the coil spring 8 in the ignition coil 1.

The length of the large-diameter portion 81 may be, as illustrated in FIG. 6, shaped to have a plurality of largest-diameter sections 811 and the smaller-diameter section 812 which is located between the largest-diameter sections 811 and smaller in outer diameter than the largest-diameter sections 811. Specifically, in the example of FIG. 6, the smaller-diameter section 812 occupies the central portion of the length of the coil spring 8 in the axial direction L. The largest-diameter sections 811 are located on opposite sides of the smaller-diameter section 812 in the axial direction L. The smaller-diameter section 812 may have an outer diameter smaller than that of the small-diameter sections 82.

The coil spring 8 also has the dense-turn portions 83 which are located between the large-diameter portion 81 and each of the small-diameter portions 82 and in a central region of the length of the large-diameter portion 81. Each of the dense-turn portions 83 is larger in number of spiral turns than other portions of the wire 801 of the coil spring 8. An interval between the adjacent turns of each of the dense-turn portions 83 is smaller than that of other portions of the wire 801. Specifically, the turns of each of the dense-turn portions 83 are arranged adjacent each other in the axial direction L and placed substantially in contact with each other. Each of the dense-turn portions 83 may be, as shown in FIG. 6, inclined relative to the length of the coil spring 8 (i.e., the axial direction L) or alternatively be, as illustrated in FIG. 2, laid horizontally or perpendicular to the axial direction L. The dense-turn portions 83 work as reinforcements to enhance the stiffness of the coil spring 8. The locations and/or the number of the dense-turn portions 83 may be selected to increase the resistance of the coil spring 8 to buckling thereof or ensure desired spring characteristics of the whole of the coil spring 8.

The large-diameter portion 81 of the coil spring 8 is, as clearly illustrated in FIG. 2, disposed inside the contact hole 51 of the cylindrical joint 5. The largest-diameter sections 811 of the large-diameter portion 81 of the coil spring 8 are placed in contact with the straight line segments 521 of the contact hole 51, thereby reducing mechanical vibration of the coil spring 8 in a direction perpendicular to the axial direction L.

The insertion of the coil spring 8 into the hole 50 of the cylindrical joint 5 is enabled by selecting the inner diameter of the hole 50 of the cylindrical joint 5 to be larger than the outer diameter of the coil spring 8 to form a clearance between the hole 50 and the coil spring 8. The hole 50 is shaped to have the contact hole 51 to create a plurality of decreased clearances between the straight line segments 521 and the outer periphery of the coil spring 8 which are arranged adjacent each other in the circumferential direction C. The above structure of the cylindrical joint 5 serves to minimize the mechanical vibration of the coil spring 8 in the direction perpendicular to the length of the coil spring 8 without sacrificing the ease of insertion of the coil spring 8 into the hole 50.

Each of the straight line segments 521 of the contact hole 51, as can be seen in FIG. 3, is oriented to extend parallel to a tangent line to the hole 50 of the cylindrical joint 5 in a plan view extending perpendicular to the axial direction L. The central portion 521A of the length of each of the straight line segments 521 and the outer periphery of the coil spring 8 which faces the central portion 521A are oriented substantially parallel to each other in the circumferential direction C of the cylindrical joint 5 and the coil spring 8. This layout eliminates a probability that the wire 801 of the coil spring 8 may be brought into near point contact with the hole 50 of the cylindrical joint 5, but is capable of creating spiral line contacts of the wire 801 of the coil spring 8 with the hole 50 of the cylindrical joint 5.

Usually, an electric field, as produced around the coil spring 8 when a high-voltage electric current occurring in the secondary winding 3 flows through the coil spring 8, increases and concentrates at contacts of the wire 801 of the coil spring 8 with the cylindrical joint 5 or in regions where the wire 801 of the coil spring 8 is closest to the cylindrical joint 5. A leakage of electric current may occur around the above contacts or the above regions due to a potential difference between the high-voltage occurring in the coil spring 8 and the ground potential at the cylinder head.

In a case where a prior art ignition coil is designed to have a plurality of inward protruding ribs which are formed on an inner wall of the hole 50 of the cylindrical joint 5 and arranged adjacent each other in the circumferential direction C, an electric field usually concentrates on heads of the ribs which face inwardly in the hole 50 and bases of the ribs facing outward away from the heads, which leads to a risk that an electric current may leak from the outward bases of the ribs to the outer periphery of the cylindrical joint 5.

The ignition coil 1 in this embodiment is designed not to have ribs on the inner wall of the hole 50 of the cylindrical joint 5, in other words, there is no protrusions facing inward in the hole 50 of the cylindrical joint 5. The wire 801 of the coil spring 8 is brought into line contact with the inner wall, i.e., the straight line segments 521 of the hole 50 of the cylindrical joint 5. This minimizes a risk that the electric field may concentrate on the cylindrical joint 5 and the coil spring 8, which results in leakage of electric current to the outer periphery of the cylindrical joint 5.

Stopper Hole 54 of Cylindrical Joint 5

Figure 7:
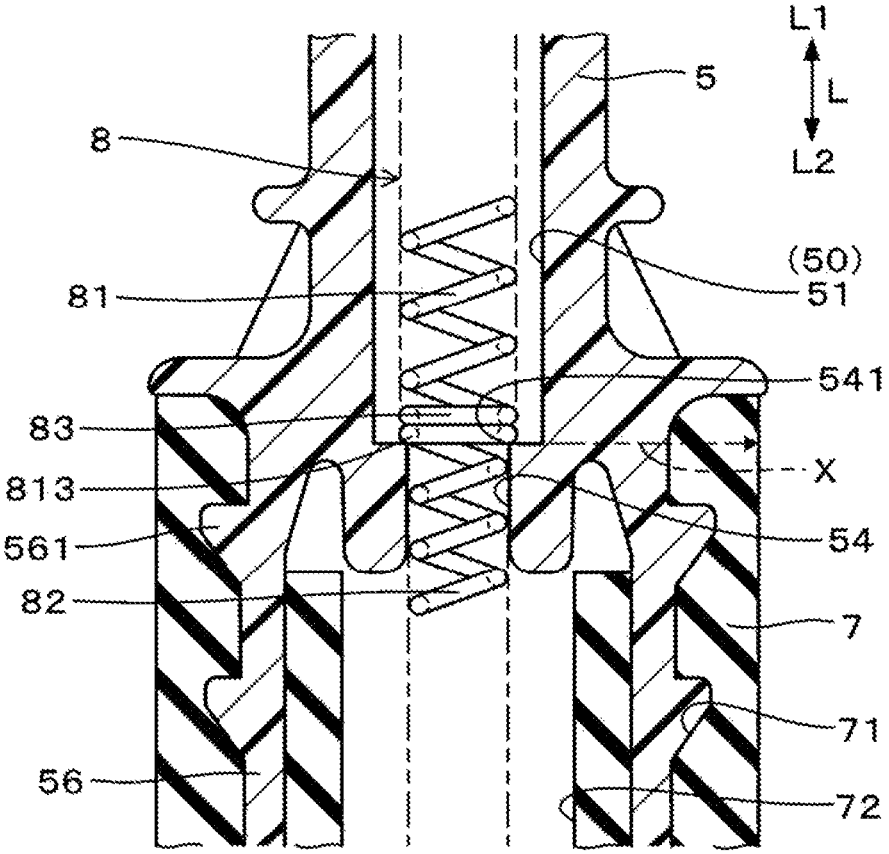
FIG. 7 is a partially enlarged longitudinal sectional view which illustrates a fit of a plug cap on a cylindrical joint of an ignition coil according to the first embodiment.

The cylindrical joint 5, as illustrated in FIG. 7, has the stopper hole 54 formed adjacent an end of the length of the hole 50 close to or facing the front end L2 of the ignition coil 1. In other words, the stopper hole 54 is formed adjacent an end of the contact hole 51 which faces the front end L2 of the ignition coil 1 (the cylindrical joint 5) and has an inner diameter which is smaller than that of the hole 50, in other words, the smallest in the hole 50. The stopper hole 54 serves to retain an end of the length of the large-diameter portion 81 of the coil spring 8 which faces the front end L2 of the ignition coil 1. The large-diameter portion 81 of the coil spring 8 is disposed in the contact hole 51 from in the central portion 501 of the length of the hole 50 in the axial direction L. One of the small-diameter portions 82 of the coil spring 8 which is located close to the front end L2 of the ignition coil 1 is disposed in the stopper hole 54. The large-diameter portion 81 of the coil spring 8 has the shoulder 813 defined by an end of the length of the large-diameter portion 81 which faces the front end L2 of the ignition coil 1. The shoulder 831 of the large-diameter portion 81 rests on the shoulder 541 serving as a seat defined by an end of the stopper hole 54, in other words, an inner portion of the cylindrical joint 5 which defines an end of the hole 50 which faces the base end L1 of the ignition coil 1, thereby stopping the coil spring 8 disposed inside the hole 130 of the plug boot 13 from being accidentally removed outside the hole 130.

The plug gap 7 lies outside the shoulder 541 of the stopper hole 54 in a radial direction of the cylindrical joint 5. In other words, the plug cap 7 has an end which faces the base end L1 of the ignition coil 1 and is located outside the shoulder 541 in the radial direction of the cylindrical joint 5. The shoulder 541 is located on the end of the stopper hole 54 which faces the base end L1 of the ignition coil 1 (i.e., the cylindrical joint 5). The shoulder 541 of the stopper hole 54 creates a sharply changed shape of a portion of the hole 50 of the cylindrical joint 5. The electric field will usually concentrate on such a sharp portion of the hole 50 when a high-voltage current flows in the coil spring 8. The plug cap 7 which is located radially outside the shoulder 541 of the stopper hole 54, however, serves to enhance the voltage resistance outside the shoulder 541 of the stopper hole 54, thereby minimizing a risk that the concentration of electric field around the shoulder 541 of the stopper hole 54 may result in leakage of electric current, as indicated by a chain double-dashed line X in FIG. 7, which flows to the outer periphery of the cylindrical joint 5.

Beneficial Advantages

The ignition coil 1 in this embodiment has a unique shape of the cylindrical joint 5 of the plug boot 13 which is designed to enhance vibration and voltage resistance of the coil spring 8. Specifically, the hole 50 of the cylindrical joint 5 has the contact hole 51 continuously extending in the axial direction L. The contact hole 51 is geometrically shaped by the straight line segments 521 (i.e., the small distance-to-center sections 52) and the corners 531 (i.e., the large distance-to-center sections 53) which are arranged alternately in the circumferential direction C of the hole 50.

Each of the straight line segments 521 is shaped to extend straight in a plane defined to extend perpendicular to the axial direction L of the hole 50. This causes the wire 801 of the coil spring 8 to make physical contacts with the straight line segments 521 in the shape of lines extending obliquely to the axial direction L. The contacts are arranged adjacent each other in the circumferential direction C. The straight line segments 521 are each designed not to exhibit a sharp shape in the hole 50.

The plurality of straight line segments 521 serve to minimize mechanical vibrations of the coil spring 8 in a direction perpendicular to the axial direction L within the hole 130 of the plug boot 13, minimize occurrence of concentration of electric field between the coil spring 8 and the cylindrical joint 5 when the ignition coil 1 is being activated, and eliminate a possibility that a portion(s) of the coil spring 8 may be caught undesirably in an recess inside the hole 50 to avoid occurrence of leakage of electric current from the coil spring 8.

As apparent from the above discussion, the structure of the ignition coil 1 in this embodiment has enhanced resistance to mechanical vibration of the coil spring 8 and also has an enhanced ability to withstand voltage.

Second Embodiment

The ignition coil 1 in this embodiment is different in shape of a cross section of the contact hole 51 of the cylindrical joint 5 from that in the first embodiment.

Figure 8:
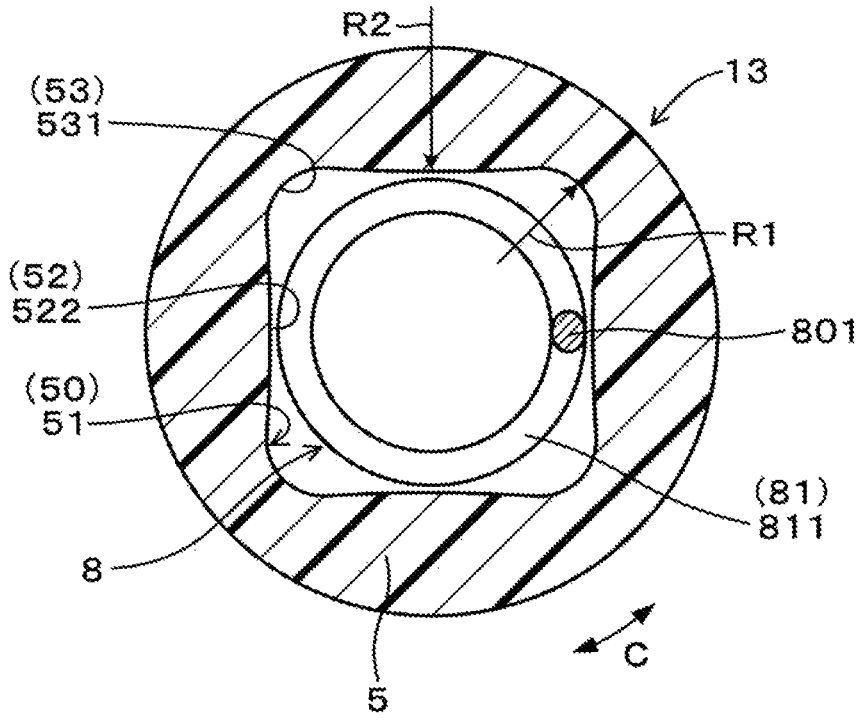
FIG. 8 is a transverse sectional view which illustrates a plug boot according to the second embodiment.

The contact hole 51 is, as illustrated in FIG. 8, shaped to have a plurality of gently curved segments 522 in a transverse cross section of the cylindrical joint 13 extending perpendicular to the axial direction L instead of the straight line segments 521 (i.e., the small distance-to-center sections 52) in the first embodiment. Each of the curved segments 522 bulges radially inward in the contact hole 51. Each of the curved segments 522 has a radius of curvature R2 (which will also be referred to as a second radius of curvature) which is larger than a radius of curvature R1 (which will also be referred to as a first radius of curvature) of the corners 531 of the contact hole 51. Each of the corners 531 connects a respective adjacent two of the curved segments 522 together. The wire 80 of the coil spring 8 is enabled to have a plurality of line contacts with the curved segments 522 which are inclined relative to the axial direction L and arranged adjacent each other in the circumferential direction C. Such a structure of the contact hole 51, like in the first embodiment, creates no sharp change in shape of the inner wall of the hole 50 of the cylindrical joint 5.

Figure 9:
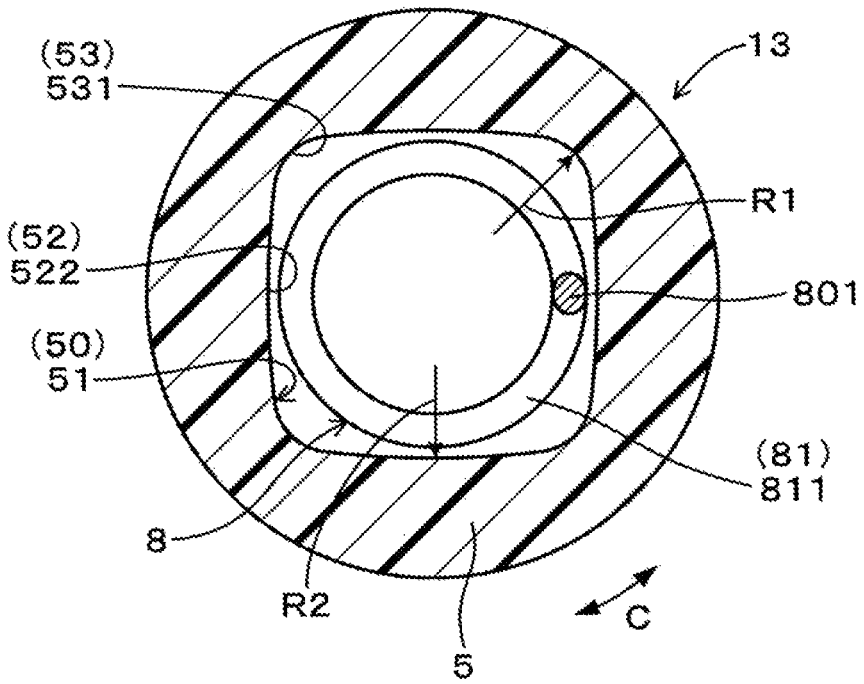
FIG. 9 is a transverse sectional view which illustrates a modification of a plug boot according to the second embodiment.

The contact hole 51 may alternatively be, as illustrated in FIG. 9, designed to have a plurality of gently curved segments 522 on a transverse cross section of the cylindrical joint 13 extending perpendicular to the axial direction L instead of the straight line segments 521 (i.e., the small distance-to-center sections 52) in the first embodiment. Each of the curved segments 522 is, unlike in FIG. 8, bulges radially outward in the contact hole 51. The wire 80 of the coil spring 8 is enabled to have a plurality of line contacts with the outward curved segments 522 which are inclined relative to the axial direction L and arranged adjacent each other in the circumferential direction C. Such a structure of the contact hole 51, like in the first embodiment, creates no sharp change in shape of the inner wall of the hole 50 of the cylindrical joint 5.

Figure 10:
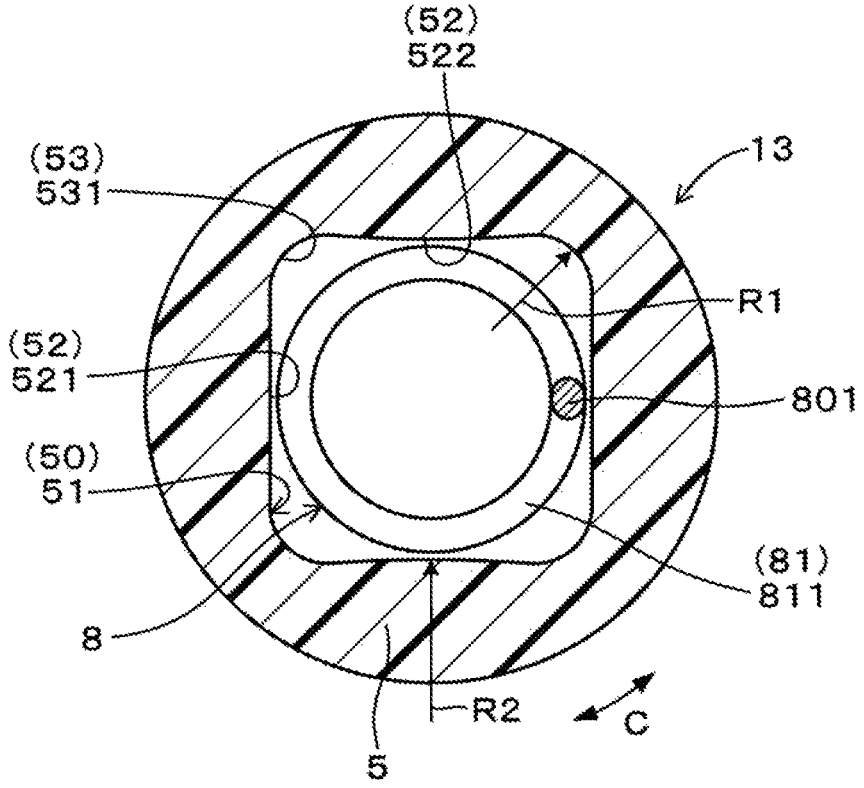
FIG. 10 is a transverse sectional view which illustrates a second modification of a plug boot according to the second embodiment.

The contact hole 51 may alternatively be, as illustrated in FIG. 10, designed to have a plurality of straight line segments 521 (i.e., the small distance-to-center sections 52) and a plurality of curved segments 522 on a transverse cross section of the cylindrical joint 13 extending perpendicular to the axial direction L. The straight line segments 521 and the curved segments 522 are arranged alternately to define a polygonal shape of the contact hole 51. Each of the corners 531 connects between the adjacent straight line segment 521 and the adjacent curved segment 522. In the example illustrated in FIG. 10, each of the curved segments 522 bulges radially inward, but however, may be shaped to bulge radially outward.

Figure 11:
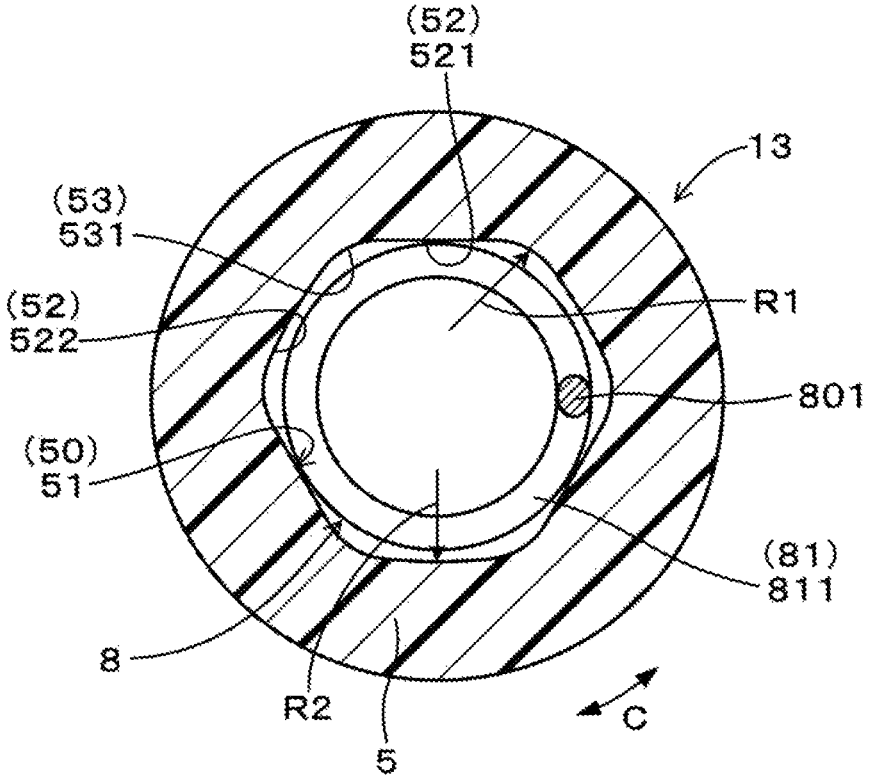
FIG. 11 is a transverse sectional view which illustrates a third modification of a plug boot according to the second embodiment.

The contact hole 51 may alternatively be, as illustrated in FIG. 11, designed to be hexagonal in shape defined by the straight line segments 521 and the curved segments 522. In the example in FIG. 11, the curved segments 522 bulge radially outward. A distance between the center of the length of each of the straight line segments 521 in the circumferential direction C and the center O of the contact hole 51 is minimized. The mechanical vibration of the coil spring 8 in a direction perpendicular to the axial direction L may be reduced by increasing the number of the straight line segments 521 or the curved segments 522 which describe sides of a polygonal shape without sacrificing the ease of insertion of the coil spring 8 into the contact hole 51.

In the above structure, the wire 80 of the coil spring 8 is enabled to have a plurality of line contacts with the straight line segments 521 or the curved segments 522. The line contacts are inclined relative to the axial direction L and arranged adjacent each other in the circumferential direction C. Such a structure of the contact hole 51, like in the above embodiments, creates no sharp change in shape of the inner wall of the hole 50 of the cylindrical joint 5.

The ignition coil 1 of this embodiment offers substantially the same beneficial advantages as those in the first embodiment. The same reference numbers as employed in the first embodiment refer to the same parts in this embodiment.

Third Embodiment

The ignition coil 1 in this embodiment is, as illustrated in FIGS. 12 to 16, designed to have selected locations of a weld W and a gate mark G created during production of the cylindrical joint 5. Specifically, the ignition coil 1 in this embodiment is engineered by selecting the locations of the weld W of the cylindrical joint 5 and the gate mark G on the cylindrical joint 5 in order to enhance the ability of the cylindrical joint 5 to withstand voltage.

The cylindrical joint 5 is made by injecting molten thermoplastic resin into the mould 9. The mould 9 has the cylindrical cavity 91 used in forming the cylindrical joint 5 and the gate 92 which communicates with the cavity 91 and through which the molten resin material 500 (i.e., thermoplastic resin) is injected into the cavity 91. After being injected into the mould 9 through the gate 92, the resin material 500 will flow along the contour of the cavity 91 and fully occupy the volume of the cavity 91. The cavity 91 has an axial direction aligned with the axial direction L of the cylindrical joint 5. The circumferential direction of the cavity 91 also coincides with the circumferential direction C of the cylindrical joint 5.

Figure 14:
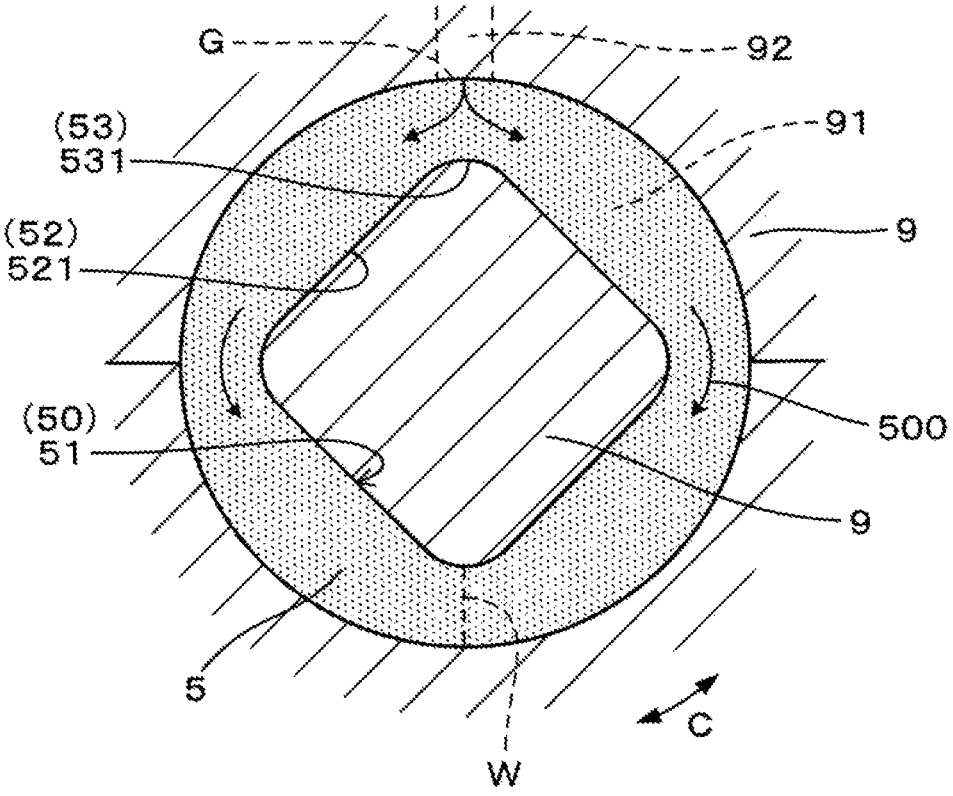
FIG. 14 is a transverse sectional view which illustrates a mould for producing a cylindrical joint of an ignition coil according to the third embodiment.

The cylindrical joint 5 formed by the resin material 500 injected into the cavity 91, as illustrated in FIG. 14, usually has the weld W created by meeting of flows of the molten resin material 500 somewhere in the circumference of the cavity 91. The weld W extends in the shape of a line substantially parallel to the axial direction L somewhere in the circumference of the cylindrical joint 5. The weld W is lower in mechanical strength or toughness than the rest of the material of the cylindrical joint 5.

A portion of an outer peripheral surface of the cylindrical joint 5 which leads to the gate 92 within the cavity 91 will have the gate mark G after the completion of injection molding of the cylindrical joint 5. The gate mark G has the second lowest mechanical strength or toughness next to the weld W. The gate mark G is usually formed on the surface of the cylindrical joint 5 by cutting or removing a protrusion of the cylindrical joint 5 made by a portion of the injected molten resin material 500 left inside the gate 92.

The mould 9 may alternatively be designed to have a plurality of gates 92 communicating with the cavity 91. This structure will cause the cylindrical joint 5 to have as many gate marks G as the gates 92 on the outer periphery thereof.

The cylindrical joint 5 may also have a plurality of welds W formed adjacent each other in the circumferential direction C of the cavity 91.

Figure 13:
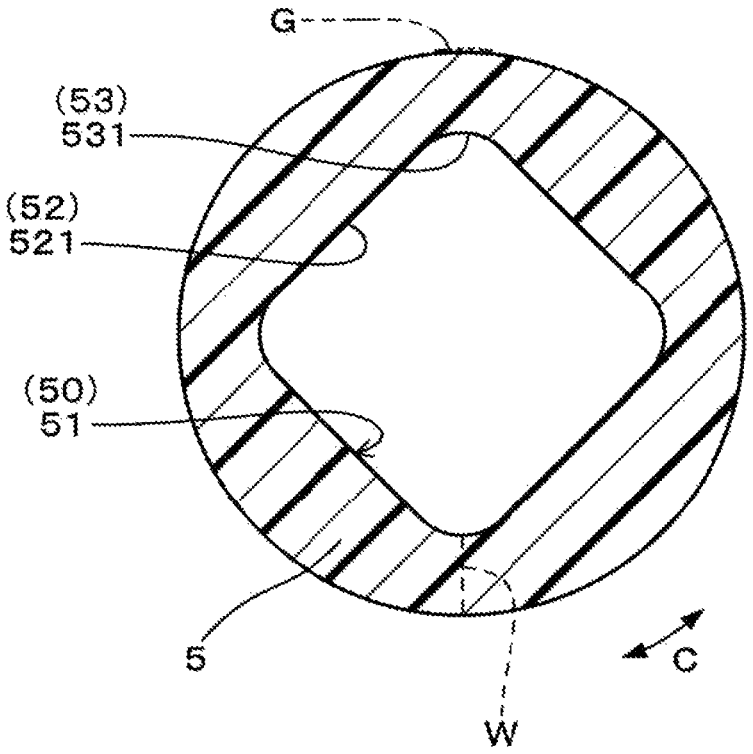
FIG. 13 is a transverse sectional view which illustrates a cylindrical joint of an ignition coil according to the third embodiment.

In the example illustrated in FIGS. 13 and 14 where the mould 9 has only the single gate 92 leading to a portion of the circumference of the cavity 91, the gate mark G and the weld W are usually located at an interval of 180° away from each other in the circumferential direction C of the cylindrical joint 5. In a case where the mould 9 has two gates 92 arranged away from each other in the circumferential direction C of the cavity 91, the weld G, as illustrated in FIG. 15, usually appears farthest away from the gate marks G in the circumferential direction C of the cylindrical joint 5.

Figure 12:
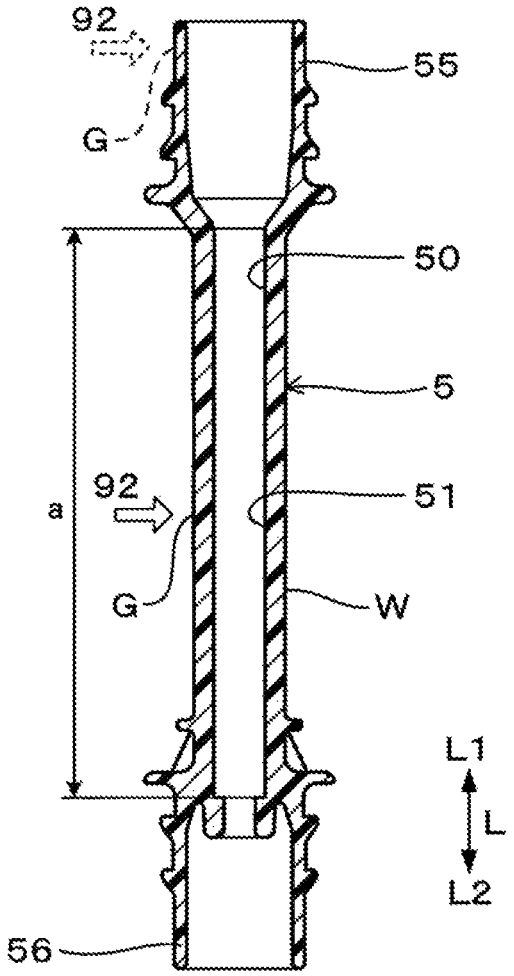
FIG. 12 is a longitudinal sectional view which illustrates a cylindrical joint of an ignition coil according to the third embodiment.

The weld W, as arising from merging of flows of molten resin material 500 during the production of the cylindrical joint 5, is created using one of some of the corners 531 (i.e., the large distance-to-center sections 53). In this embodiment, the weld W occupies a portion of the circumference of the cylindrical joint 5 which is located radially outside near the vertex of one of the corners 531. The weld W continues from one of the corners 531 and, as can be seen in FIG. 12, also extends from a portion of the cylindrical joint 5 in which the contact hole 51 is formed both to the base-end fastening portion 55 and to the front-end fastening portion 56 in the axial direction L of the cylindrical joint 5. In other words, the weld W also occupies portions of the base-end fastening portion 55 and the front-end fastening portion 56 in the axial direction L. Symbol "a" in FIG. 12 indicates a region where a portion of the weld W which appears radially outside the contact hole 51 extends in the axial direction L.

The contact hole 51 is shaped to have a quadrangular transverse cross section, but however, may alternatively have a triangular, pentagonal, or hexagonal transverse cross section. When the contact hole 51 is of a quadrangular shape in transverse cross section, the weld W, as demonstrated in FIGS. 13 and 16, may be formed radially outside the vertex of one of the corners 531 of the contact hole 51 of the cylindrical joint 5. In this case, the gate mark G is formed on a portion of the surface of the circumference of the cylindrical joint 5 which is diametrically opposed to the weld W.

Figure 15:
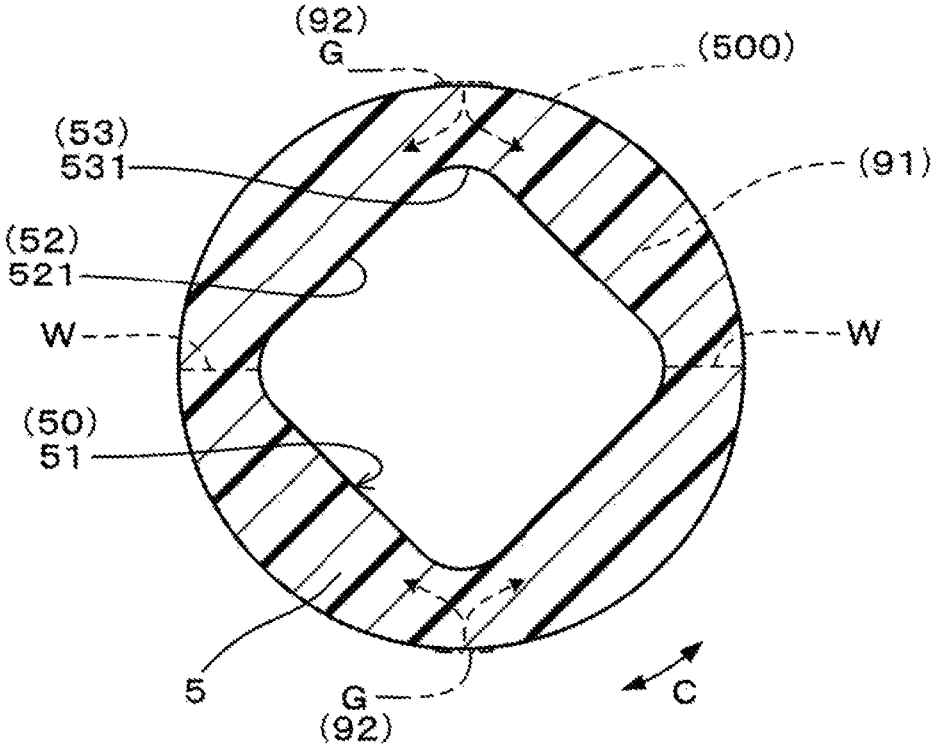
FIG. 15 is a transverse sectional view which illustrates a cylindrical joint of an ignition coil according to the third embodiment.

The cylindrical joint 5 may, as illustrated in FIG. 15, have the welds W formed radially outside vertexes of two of the corners 531 which are diametrically opposed to each other across the contact hole 51. In this example, the gate marks G appear radially outside remaining two of the corners 531. In other words, each of the gate marks G is located intermediate between the welds W in the circumferential direction C of the cylindrical joint 5.

The gate mark G, as created during the production of the cylindrical joint 5, is formed on the outer peripheral surface of a portion of the cylindrical joint 5 in which the contact hole 51 is formed and which is located radially outside one of the corners 531 of the contact hole 51 and/or appears on the outer peripheral surface of a portion of the cylindrical joint 5 excluding the contact hole 51, that is, the portion of the cylindrical joint 5 which is located radially outside the one of the corners 531. In the example illustrated in FIG. 14 where the gate 92 of the mould 9 is located radially outside one of the corners 531 of the square contact hole 51, the molten resin material 500 flows, as indicated by solid arrows, from the gate 92 both in opposite circumferential directions in the cavity 91 and in opposite directions along the axis of the cavity 91 (i.e., along the length of the cylindrical joint 5).

Upon finishing of production of the cylindrical joint 5, the gate mark G is formed radially outside one of the corners 531 of the contact hole 51. The weld W is, as already described above, formed in a portion of the cylindrical joint 5 which is located radially outside one of the corners 531 which is diametrically opposed to the gate mark G. The weld W also extends from a portion of the cylindrical joint 5 in which the hole 50 lies both to the base-end fastening portion 55 and the front-end fastening portion 56 in the axial direction L. In some cases, the weld W does not appear or partially appears in the base-end fastening portion 55 and the front-end fastening portion 56 depending upon how the molten resin material 500 flows in the mould 9.

In the example in FIG. 15 where the mould 9 is designed to have the gates 92 radially outside portions of the cavity 91 where diametrically opposed two of the corners 531 of the square contact hole 51 are formed, the molten resin material 500 flows from each of the gates 92 in opposite directions along the axis of the cavity 91 and in opposite directions along the circumference of the cavity 91. In FIG. 15, the cavity 91, the gates 92, and the resin material 500 are indicated by numerals in parentheses. Upon finishing of production of the cylindrical joint 5, the gate marks G are formed radially outside two of the corners 531 of the contact hole 51. The welds W are, as already described above, formed in portions of the cylindrical joint 5 which are located radially outside remaining two of the corners 531 which are diametrically opposed to each other.

In an example where the mould 9 is designed to have the gate 92 which is, as indicated by a broken arrow in FIG. 12, located in a portion of the cavity 91 where the base-end fastening portion 55 or the front-end fastening portion 56 is formed, the molten resin material 500 flows from the gate 92 in only one of opposite directions along the center axis of the cavity 91. The molten resin material 500 also flows in the circumferential direction C in the cavity 91 to create the weld W diametrically opposed to the gate 92. In this case, the location of the gate 92 is selected not to create the weld W radially outside one of the straight line segments 521 or the curved segments 522 of the contact hole 51. In other word, the location of the gate 92 is selected to make the weld W located radially outside one of the corners 531 of the contact hole 51 over a region where a portion of the cylindrical joint 5 in which the contact hole 51 is formed and which extends in the axial direction L. In this case, the ease with which the weld W is formed is reduced as leaving from the gate 92 in the axial direction L.

When the cylindrical joint 5 equipped with the contact hole having the even number of hexagonal or octagonal corners 531 is moulded, locations of the gate mark(s) G and the weld(s) W may be selected in the same way as that in which the joint 5 equipped with the square contact hole 51. When the cylindrical joint 5 equipped with the contact hole having the odd number of triangular or pentagonal corners 531 is moulded, the weld(s) W is required to be located radially outside one(s) of the corners 531 of the contact hole 51, thus requiring the gate(s) 92 of the mould 9 leading to the cavity 91 to be arranged radially outside the straight line segments 521 (or the curved segments 522) of the contact hole 51. In such a case, the gate(s) 92 may be located away from a location radially outside the straight line segments 521 (or the curved segments 522) in the axial direction L.

When the cylindrical joint 5 equipped with the contact hole having the odd number of corners 531 is moulded, there is a higher need to mechanically protect the weld(s) W than the gate mark(s) G. It is highly necessary for the weld(s) W to be formed radially outside one(s) of the corners 531. In such as case, the gate mark(s) G is required to be located to radially face the base-end fastening portion 55 and the front-end fastening portion 56 of the cylindrical joint 5 which are located on the opposite sides of the contact hole 51 in the axial direction L.

Figure 16:
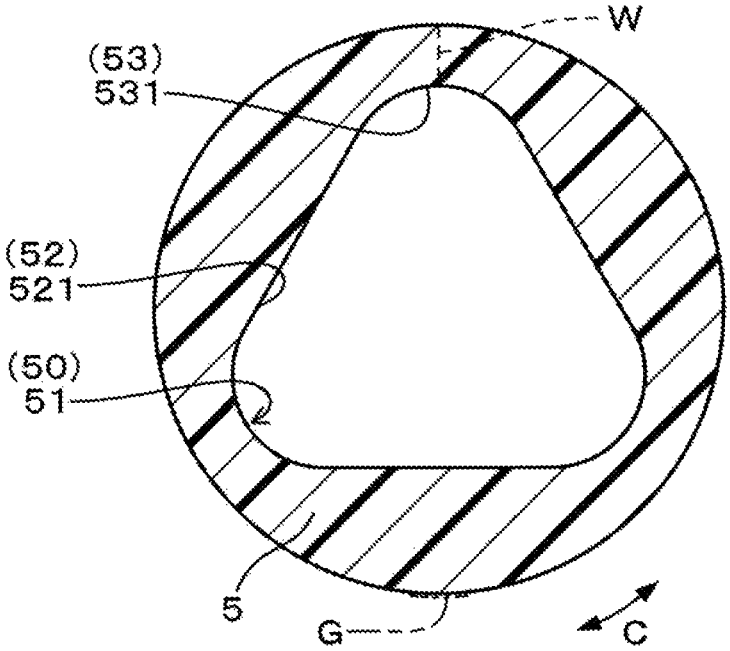
FIG. 16 is a transverse sectional view which illustrates a modification of a cylindrical joint of an ignition coil according to the third embodiment.

When the gate 92 of the mould 9 is arranged radially outside one of the straight line segments 521 (or the curved segments 522) of the rectangular contact hole 51 illustrated in FIG. 16, the molten resin material 500 flows from the gate 92 in opposite axial directions (i.e., the axial directions L) within the cavity 91 and also flows in opposite circumferential directions (i.e., the circumferential directions C) of the cavity 91. Subsequently, upon completion of production of the cylindrical joint 5 in the cavity 91, the gate mark G appears on a portion of the surface of the cylindrical joint 5 which is located radially outside one of the straight line segments 521 (or the curved segments 522) of the contact hole 51. Additionally, the weld W appears in a portion of the cylindrical joint 5 which is located radially outside one of the corners 531 and diametrically opposed to the gate mark G created outside the straight line segment 521 (or the curved segment 522). The state of portions of the weld W formed in the base-end fastening portion 55 and the front-end fastening portion 56 is the same as the above described cylindrical joint 5 equipped with the square contact hole 51.

Beneficial Advantages

The cylindrical joint 5 in the first and second embodiments is designed not to create point contacts of the coil spring 8 with the straight line segments 521 (or the curved segments 522) of the contact hole 51 of the cylindrical joint 5 in order to minimize a risk that electric field may concentrate between the coil spring 8 and the cylindrical joint 5. The line contacts of the coil spring 8 with the straight line segments 521 (or the curved segments 522) of the contact hole 51 will, however, facilitate concentration of electric field on the line contacts, while the vertexes of the corners 531 of the contact hole 51 of the cylindrical joint 5 are farthest away from the coil spring 8, thereby resulting in almost no risk that the coil spring 8 may contact each of the corners 531.

The structure of the ignition coil 1 in this embodiment is, therefore, designed not to have the mechanically fragile weld(s) W located radially outside the straight line segment (s) 521 (or the curved segment(s) 522) of the contact hole 51, in other words, designed to have the weld(s) W located radially outside one(s) of the corners 531 even when the coil spring 8 line-contacts the straight line segment(s) 521 (or the curved segment(s) 522) of the contact hole 51, thereby protecting the weld(s) W from being damaged by the electric field. Additionally, the structure of the ignition coil 1 in this embodiment is designed to have the gate mark(s) G formed on a portion(s) of the outer surface of the cylindrical joint 5 which is arranged radially outside one(s) of the corners 531 of the contact hole 51 or away from the corner(s) 531 of the contact hole 51 to the base end or the front end of the cylindrical joint 5 in the axial direction L, thereby protecting the gate mark(s) G from being damaged by the electric field.

The structure of the ignition coil 1 in this embodiment, therefore, has an enhanced electric strength to protect the coil spring 8 from the voltage. The ignition coil 1 in this embodiment offers substantially the same beneficial advantages as those in the first and second embodiments. The same reference numbers as employed in the first embodiment refer to the same or similar parts.

While the preferred embodiments have been disclosed in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An ignition coil for an internal combustion engine comprising:

a coil body which includes a primary winding, a secondary winding magnetically coupled with the primary winding, and a case in which the primary winding and the secondary winding are disposed, the coil body being configured to be arranged outside a plug hole of an internal combustion engine; and a joint which includes a coil spring and a plug boot and is configured to be arranged inside the plug hole, the coil spring electrically connecting between a high-voltage end of the secondary winding with a spark plug, the plug boot connecting with the case and having a hole in which the coil spring is disposed, wherein the hole has a length extending in an axial direction of the plug boot, the length having at least a portion which includes a plurality of small distance-to-center sections and a plurality of large distance-to-center sections which are arranged alternately in a circumferential direction of the hole, and each of the small distance-to-center sections is located at a first distance away from a center of the hole, each of the large distance-to-center sections being located at a second distance away from the center of the hole, the second distance being larger than the first distance, the small distance-to-center sections being configured to be line-contactable with an outer periphery of the coil spring.

2. The ignition coil as set forth in claim 1, wherein the hole has a contact hole formed by a portion of the length of the hole and defined by the small distance-to-center sections and the large distance-to-center sections, the contact hole being shaped to have a cross section which extends perpendicular to the axial direction and is defined by a plurality of straight line segments and a plurality of corners, the straight line segments corresponding to sides of a polygon, each of the corners connecting an adjacent two of the straight line segments, and wherein each of the small distance-to-center sections is defined by one of the straight line segments, and each of the large distance-to-center sections is defined by one of the corners.

3. The ignition coil as set forth in claim 1, wherein the hole has a contact hole which is formed by a portion of the length of the hole and defined by the small distance-to-center sections and the large distance-to-center sections, the contact hole being shaped to have a cross section which extends perpendicular to the axial direction and is defined by a plurality of curved segments and a plurality of corners, the curved segments bulging radially inward or outward to have a radius of curvature which is larger than a radius of curvature of the corners of the contact hole and corresponding to sides of a polygon, each of the corners connecting an adjacent two of the curved segments and corresponding to corners of the polygon, and wherein each of the small distance-to-center sections is defined by one of the curved segments, and each of the large distance-to-center sections is defined by one of the corners.

4. The ignition coil as set forth in claim 1, wherein the hole has a contact hole which is formed by a portion of the length of the hole and defined by the small distance-to-center sections and the large distance-to-center sections, the contact hole being shaped to have a cross section which extends perpendicular to the axial direction and is defined by a plurality of straight line segments, a plurality of curved segments, and a plurality of corners, the straight line segments corresponding to ones of sides of a polygon, the curved segments bulging radially inward or outward to have a radius of curvature which is larger than a radius of curvature of the corners of the contact hole and corresponding to ones of the sides of the polygon, each of the corners connecting one of the straight line segments and one of the curved segments and corresponding to corners of the polygon, and wherein the small distance-to-center sections are defined by the straight line segments and the curved segments, and each of the large distance-to-center sections is defined by one of the corners.

5. The ignition coil as set forth in claim 2, wherein the contact hole has a length occupying more than or equal to one-half of an entire length of the coil spring in the axial direction.

6. The ignition coil as set forth in claim 1, wherein the coil spring has a length which includes a large-diameter portion and two small-diameter portions, the large-diameter portion being is the largest in diameter of the length of the coil spring and interposed between the small-diameter portions in the axial direction, and the small-diameter portions are smaller in diameter than the large-diameter portion and symmetrical in shape thereof with respect to a center of the length of the coil spring.

7. The ignition coil as set forth in claim 6, wherein the plug boot includes a resinous hollow cylindrical joint in which the hole is formed, a rubber seal, and a rubber-made plug cap, the rubber seal being connected to a base end of a length of the cylindrical joint and the case of the coil body, the plug cap connecting with a front end of the length of the cylindrical joint and being configured to be fit on the spark plug, the cylindrical joint has a stopper hole which is formed adjacent an end of the length of the hole close to the front end of the cylindrical joint and has an inner diameter smallest in the hole, the stopper hole serving to retain an end of the length of the large-diameter portion of the coil spring, the stopper hole has a shoulder which is located on an end thereof which faces the base end in the axial direction, and the plug cap is located outside the shoulder in a radial direction of the cylindrical joint.

8. The ignition coil as set forth in claim 2, wherein the plug boot includes a resinous cylindrical joint in which the hole is formed, and the cylindrical joint has a weld(s) created using one(s) of the corners by merging of flows of a molten resin material for use in moulding the cylindrical joint.

9. The ignition coil as set forth in claim 8, wherein the cylindrical joint has a gate mark formed on a portion of an outer surface of the cylindrical joint which is located radially outside one of the corners of the contact hole or on a portion of the outer surface of the cylindrical joint excluding the portion of the outer surface of the cylindrical joint located radially outside the one of the corners of the contact hole, the gate mark being created when the cylindrical joint is moulded.

* * * * *